United States Patent [19]

Strasser et al.

[11] 4,356,662

[45] Nov. 2, 1982

[54] MODEL ROCKETRY SPLIT NOSE EJECTION

[76] Inventors: Gene Strasser, c/o George Spector, 3615 Woolworth Bldg., 233 Broadway; George Spector, 3615 Woolworth Bldg., 233 Broadway, both of New York, N.Y. 10007

[21] Appl. No.: 252,077

[22] Filed: Apr. 8, 1981

[51] Int. Cl.[3] ..... A63H 27/00; A63H 27/14

[52] U.S. Cl. ..... 46/74 C; 46/81

[58] Field of Search ..... 46/74 A, 74 B, 86 A, 46/86 B, 86 C, 79, 80, 81

[56] References Cited

U.S. PATENT DOCUMENTS 2,997,809 8/1961 Gladen ..... 46/86 C 3,194,094 5/1964 Boswell ..... 46/86 C X

FOREIGN PATENT DOCUMENTS 29356 8/1964 German Democratic Rep. .... 46/74 A

*Primary Examiner*—F. Barry Shay

[57] ABSTRACT

A model booster rocket that is upwardly thrown by any mechanical means, and which at its apex height turns downward and its nose cone spreads open to eject a carried glider, the nose cone consisting of two pivoted jaws each having a weight that causes the jaws to spread apart when in a downwardly tilted position. Engaged teeth may be used to cause the jaws to move together. Magnetic tips may be used to lightly hold the jaws closed.

3 Claims, 4 Drawing Figures

10
11
12
13
14
15
16
17
18
19

MODEL ROCKETRY SPLIT NOSE EJECTION

This invention relates generally to model rocketry.

It is well known that numerous designs of model rockets have been developed in a past wherein, at apogee, the rocket nose cone completely separates from the rocket body in order that a contained glider may be discharged from the rocket interior.

It is a principal object of the present invention to provide a model rocket wherein, at apogee, the nose cone thereof remains integral with the rocket body, but instead the nose cone automatically splits open so that an interior glider may thus be discharged outwardly therefrom FIG. 1 is a side view of the invention showing its operation in flight.

Figures 1, 2, 3, 4:
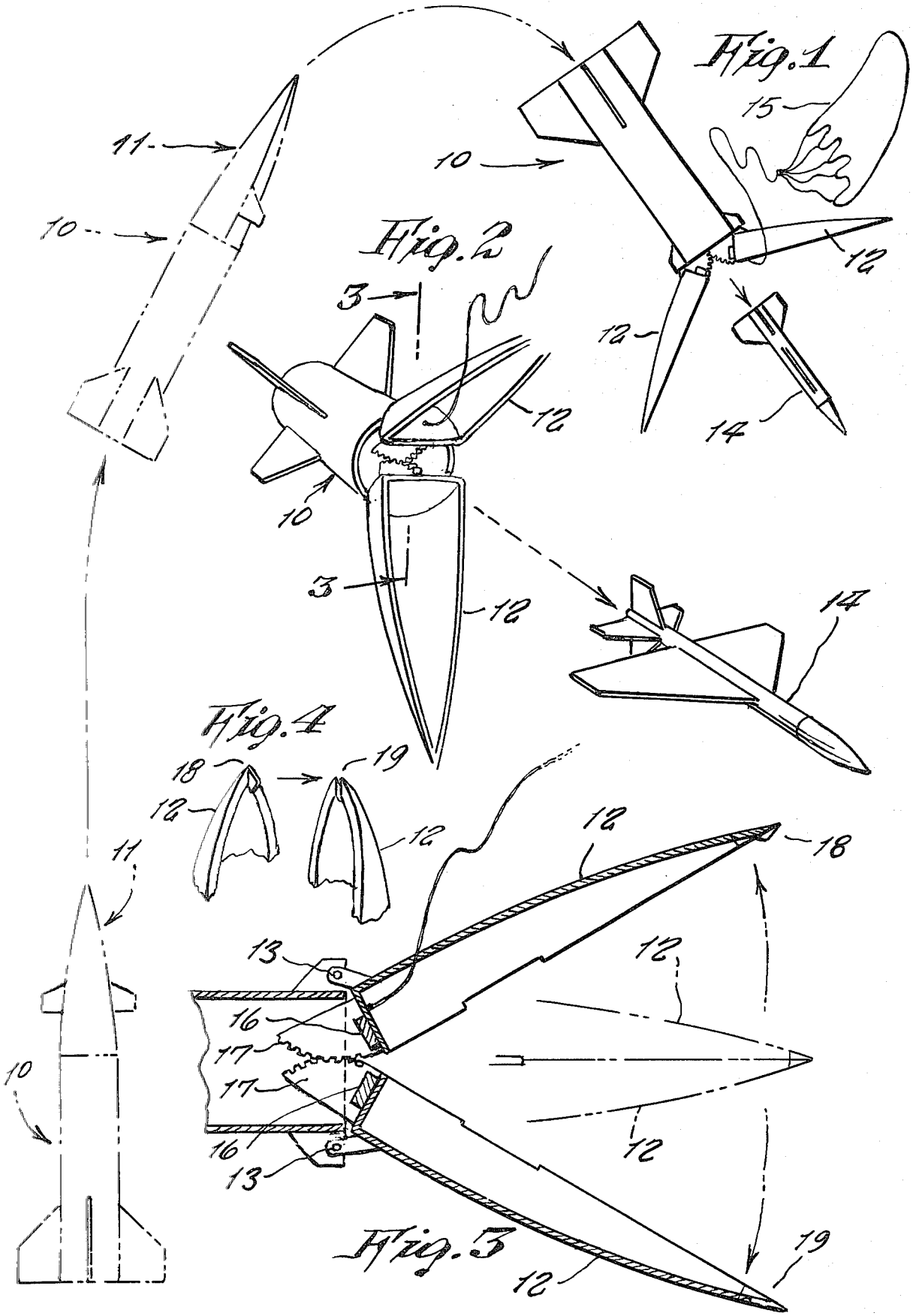
FIG. 2 is a perspective view of the rocket nose structure, with its contained nose rocket being launched therefrom.
FIG. 3 is an enlarged side cross sectional view taken on line 3—3 of FIG. 2, and showing meshed gears attached to each nose section, so that both open up together.
FIG. 4 is a detail view showing a tab on a lip of one nose section that fits in a slot of the other nose section lip, so to align the sections in closed positions, the tab and the surfaces of the slot being possibly either magnetic and steel materials, or else made friction fit in order to hold together only with slight force prior to the intended spreading of the sections.

Referring now to the drawing in greater detail, the reference numeral 10 represents a model booster rocket according to the present invention, and which includes a nose cone 11 made up of a pair of longitudinal extending nose sections or jaws 12 that are each pivotable about a pin 13 in order to spread apart, when at apogee, the rocket tilts over so that a glider 14 falls out from between the jaws for free fall flight, while a parachute 15 also stored in folded condition between the jaws falls out, the parachute being attached to the rocket so as to provide a soft landing thereto.

A weight 16 affixed on the base end of each jaws causes the jaws to open when at apogee the rocket tilts over with its nose downwardly.

In order that both jaws work simultaneously toothed sectors 17 integral with a rear end of each jaw, are tooth engaged together, as clearly shown in FIG. 3.

In a closed position, the jaws are held together by magnetic tips 18 and 19 that interfit together, one being pronged while the other is slotted for receiving the pronged one.

While various changes may be made in the detail construction, it is understood that such changes will be within the spirit and scope of the present invention as is defined by the appended claims.

What is claimed:

1. A model booster rocket assembly comprising in combination, a booster rocket including a split nose cone consisting of a pair of jaws, each said jaw being pivotable about a pin supported on a body of said rocket, and means including a weight on each said jaw, each said weight being arranged relative to the pivot pin of its associated jaw so that the effect of gravity will spread said jaws apart when said nose cone is tipped over so to point downwardly, and a glider held between said jaws thus being freed for flight.

2. The combination as set forth in claim 1, wherein additional means are included for causing both said jaws to spread simultaneously apart.

3. The combination as set forth in claim 2, wherein a parachute tethered to said rocket is stored in folded condition also between said jaws, for release outwardly when said jaws are spread apart.

* * * * *